US006758002B1

(12) United States Patent
Duguay

(10) Patent No.: US 6,758,002 B1
(45) Date of Patent: Jul. 6, 2004

(54) FLEXIBLE FACE SIGN

(75) Inventor: Eloi Duguay, Edmunston (CA)

(73) Assignee: Enseignes "Imperial" Signs Ltee/Ltd., Edmunston (CA)

( * ) Notice: Subject to any disclaimer, the term of this patent is extended or adjusted under 35 U.S.C. 154(b) by 153 days.

(21) Appl. No.: 09/723,671

(22) Filed: Nov. 28, 2000

(30) Foreign Application Priority Data

Dec. 3, 1999 (CA) ..... 2291529

(51) Int. Cl.[7] ..... G09F 13/04
(52) U.S. Cl. ..... 40/603; 40/574
(58) Field of Search ..... 40/603, 574

(56) References Cited

U.S. PATENT DOCUMENTS 4,452,000 A * 6/1984 Gandy ..... 40/574
4,542,605 A * 9/1985 Gandy ..... 40/574
4,802,296 A 2/1989 Kovalak, Jr.
5,020,254 A * 6/1991 Sheppard ..... 40/603
5,140,765 A * 8/1992 King ..... 40/603
5,992,070 A * 11/1999 Birnbaum ..... 40/603

* cited by examiner

*Primary Examiner*—Cassandra H. Davis
(74) *Attorney, Agent, or Firm*—Pearne & Gordon LLP

(57) ABSTRACT

A flexible face material sign framing system allows the interior portion of the sign casing to be accessed without removing the face material from the framing. The system includes a device for grasping the flexible face material and exerting tension to its edges in order to tighten the front of the sign appropriately. The system and device are weather-proof and therefore prolong the life of the face material.

17 Claims, 3 Drawing Sheets

FLEXIBLE FACE SIGN

FIELD OF THE INVENTION

The present invention relates in general to a flexible face sign framing system and device, and more particularly to a framing system and device which allows a sign to be opened without removing the liable material.

BACKGROUND OF THE INVENTION

Flexible face material is often used to cover the front surface of an illuminated sign. The signs mostly comprise a generally rectangular casing containing the source of illumination, and on which the front face is covered by flexible face material (flexface). The illumination means can falter or wear out before the casing and front face of the sign. Therefore, easy access to the lighting system is necessary once the sign has been installed. Because the fronts of such illuminated signs are covered by the flexface material, the usual practice for maintenance and inspection of an illumination system involves the temporary removal of the flexible face. However, because the front face is the element of the sign to which attention is meant to be drawn, the flexface material needs to be aligned perfectly without any wrinkles or folds. The proper reinstallation of the flexface after repair or maintenance can be difficult when done on site. The cyclical release of tension and reinstallation of the flexface has a detrimental fatigue effect en the face material. By constantly releasing the tension and then reapplying it, the flexface can stretch and lose its tautness, thereby affecting the aesthetics of the front of the sign Therefore, it is preferable if the flexface material is not removed from its position in the casing when access to the interior of the sign is required to repair, maintain or simply inspect the illumination system.

In addition, the methods and devices used to hold the flexface material into the sign casing need to be easy to install, remove and maintain. The signs have to be resistant to the difficult climactic conditions to which it they are subjected to once installed. Rainfall and snowfall, combined with freezing temperatures and high winds require the holding devices to withstand high pressures and forces in order to prevent the destruction of the sign. Water infiltration can cause severe damage to the structural elements of the casing of the sign, particularly if the sign is then subjected to sub-zero temperatures. Therefore, the methods and devices used to hold the sign within the casing must not only be resistant to high stress but must be watertight as well.

It is also important to maintain the integrity of the flexface material. The face of a sign can be reused and any breach of the material could substantially reduce its usefull life. Therefore, the methods and devices used must hold or grasp the flexface without ripping, cutting or piercing it.

While maintaining the resistance to the elements and the structural integrity of the flexface, the aesthetic nature of the face material must remain a key feature in illuminated signs, in particular because an even illumination of the entire flexface from edge to edge is required of an illuminated sign.

SUMMARY OF THE INVENTION

The present invention relates to a flexible face material sign framing system with illumination means therein, wherein said framing system allows easy access to the illumination mans without removing the flexible face material from the casing.

In accordance with an aspect of the present invention there is provided

BRIEF DESCRIPTION OF THE DRAWINGS

The invention will now be described with reference to the accompanying drawings which show a preferred embodiment thereof and wherein.

DETAILED DESCRIPTION OF THE PREFERRED EMBODIMENTS

Figure 1:
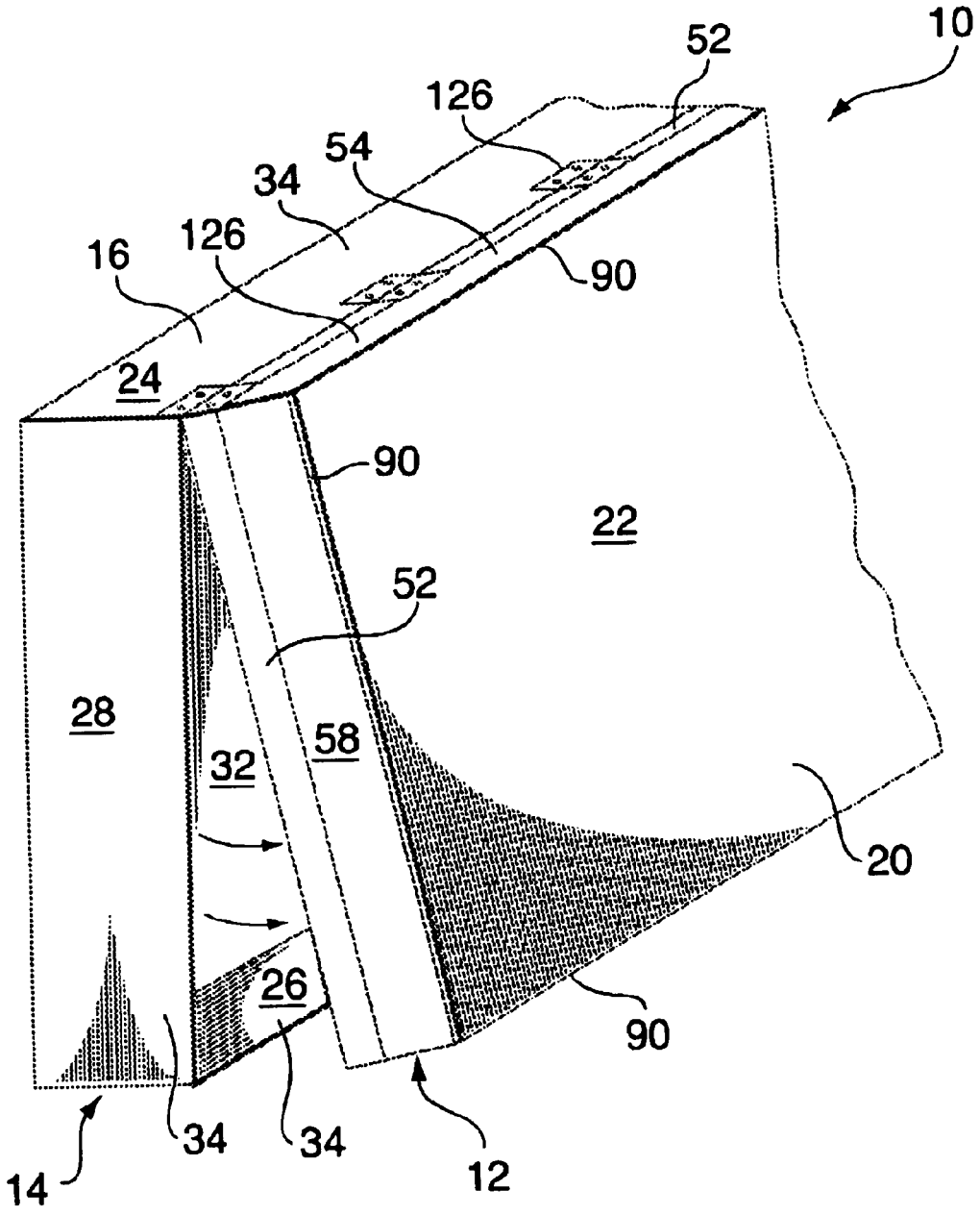
FIG. 1 illustrates in a partial perspective view, a flexible face sign framing system with a front casing pivoting about a rear casings.
Figure 2:
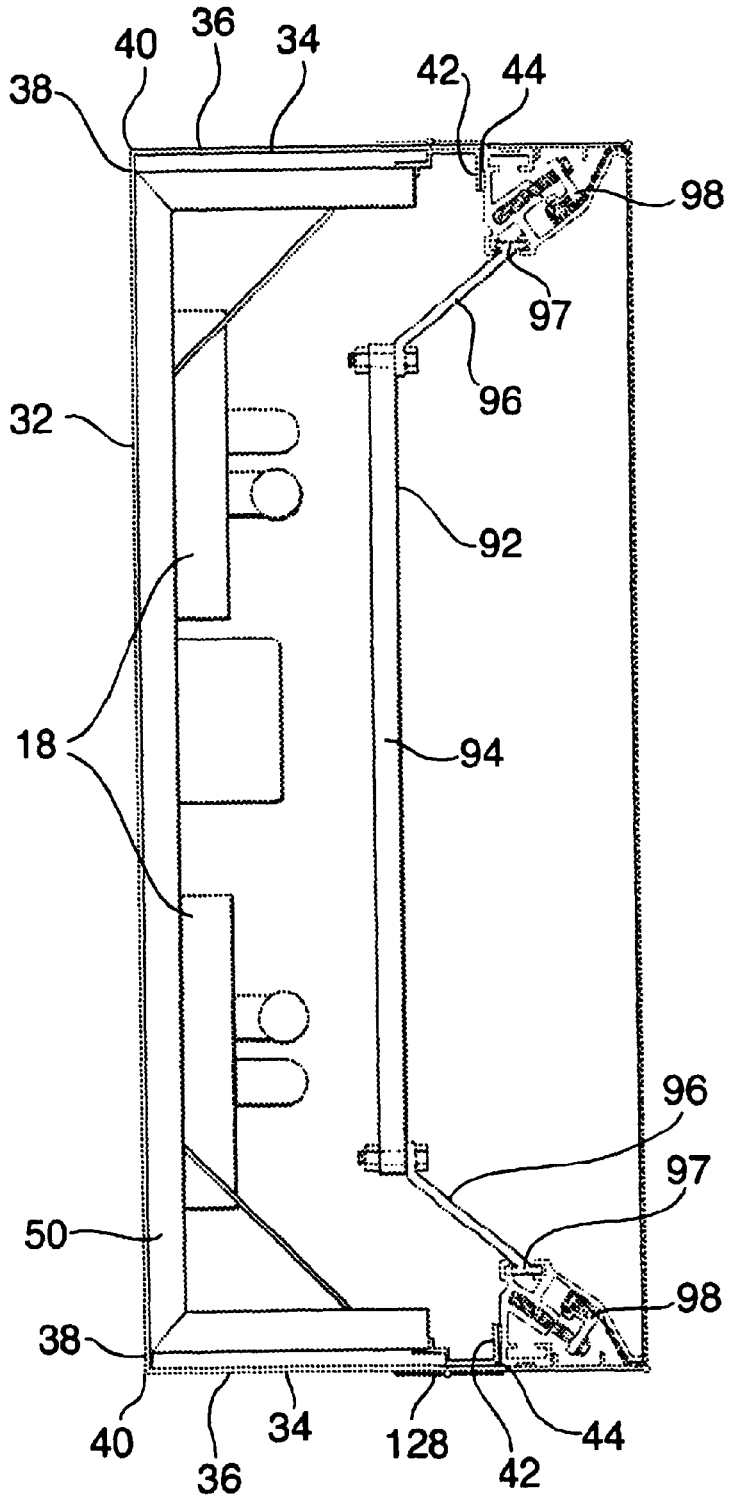
FIG. 2 illustrates in a cross-sectional view, the sign framing system of FIG. 1 along line 2—2.

Referring to FIG. 1, there is illustrated a flexible face sign framing system 10 comprising a front sign cam 12 pivotally connected to a rear sign casing 14, said front and rear sign casings forming a generally rectangular sign casing 16 for containing illumination means 18 (shown in FIG. 2). Front sign casing 12 has a front face 20 covered by a flexible face material 22 which displays the visual information of the sign, either illuminated at night or without illumination during the day.

Referring to FIGS. 1 and 2, rear sign casing 14 has an interior portion for containing illumination means 18. The rear casing is formed by a top panel 24, a bottom panel 26, a first and second end panels 28, 30 and a back panel 32, all connecting perpendicularly at the edges of the rear sign casing 14. Top, bottom and end panels 24, 26, 28 and 30 are formed in a preferred embodiment, by an aluminum extrusion 34. Extension 34 has a web portion 36, a rear flange 38 extending at right angle from the rear edge 40 of web portion 36, and a front flange 42 extending at right angle from the front edge 44 of web portion 36. The front edge 44 has an open channel 46 for receiving part of the front sign casing 12. Flat back panel 32 is secured to the rear flange 38 of the extrusion 34 of each of the panels 24, 26, 28 and 30 of the rear sign casing 14. Thus, panels 24, 26, 28 and 30 and back panel 32 form the exterior of the rear sign casing 14. A plurality of U-shaped bracing members 50 are secured to the interior of the elongated extrusion 34 of top panel 24 and bottom panel 26, and the back panel 32. U-shaped bracing members 50 are positioned in a spaced relationship longitudinally along the width of the rear sign casing 14 to improve the rigidity of the rear sign casing. Illumination means 18 are mounted on the back panel 32 and the bracing members 50, and extend longitudinally along the width of the rear sign casing 14. Reflectors 51 are diagonally mounted at the corners of the rear sign casing 14 to reflect light from the illumination means onto the front face 20.

Figure 3:
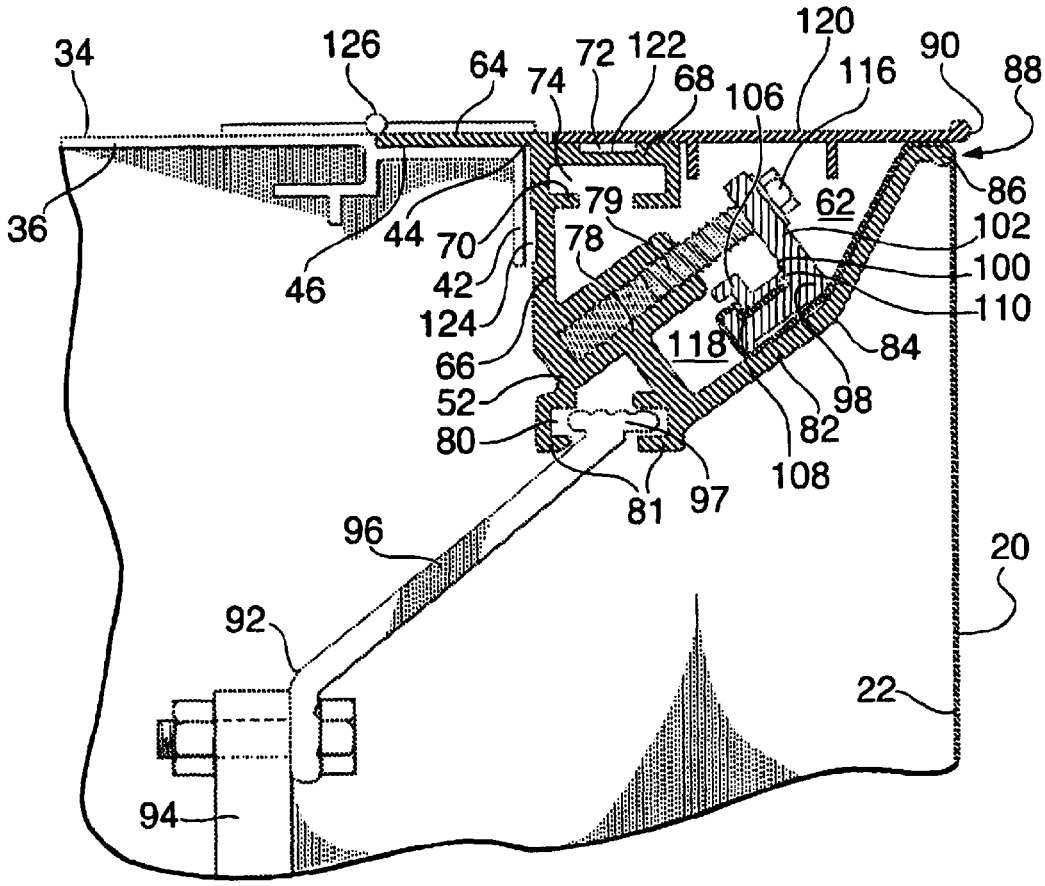
FIG. 3 illustrates in a partial cross-sectional view, the sign framing system of FIG. 1 along line 2—2.

Referring to FIG. 3, front sign casing 12 is positioned immediately in front of the rear sign casing 14 and is for supporting the flexible face material 22 onto the front face 20 of the sign casing. Front casing 12 includes a front edge member 52 which forms top member 54, bottom member 56, and first and second end members 58, 60 of the front casing. Each of the members 54, 56, 58 and 60 of the front sign casing 12 are aligned with the corresponding panels 24, 26, 28 and 30 of the rear sign casing 14. Front edge member 52 has a main recess 62 into which the flexible face material 22 is received. In a preferred embodiment, front edge member 52 is an aluminum extrusion. Front edge member 52 includes a rearwardly extending member 64 which is received in the shallow channel 46 of rear sign casing 14, and a primary member 66 extending at right angles from rearwardly extending member 64 and towards the interior portion of the front casing 12. Front edge member 52 also includes first and second slot arms 68 and 70 extending from primary member 66 substantially parallel to the rearwardly extending member 64, said first slot arm having an indentation 72 thereon. First and second slot arms 68 and 70 form a first slot 74 extending longitudinally along the length of the front edge member 52, said first slot 74 for receiving a connection tongue 76. Below first slot 74 and extending from primary member 66, there is a pair of parallel webs 78 extending longitudinally along the length of front edge member 52 and angled towards the front face 20 of the front casing 12, into recess 62. Webs 78 have ridges 79 extending longitudinally along the length of the front edge member 52. A second slot 80, extending longitudinally along the length of front edge member 52, is located under the parallel webs. An angulated arm 82 extending from the members 81 forming second slot 80 is substantially parallel to the flanges 78, said angulated arm 82 having an elbow 84 at its midpoint, and having a lip 86 at its end 88. Lip 86 of front edge member 52 on each of the members 54, 56, 58 and 60 forms a surrounding edge 90 of the front face 20 of the front sign casing 12, which front face 20 is covered by flexible face material 22.

Front sign casing 12 also includes a series of regularly spaced C-shaped bracing members 92 each secured between the top and bottom front casing members 54, 56. Each C-shaped brace 92 is made up of a spanning member 94 and a pair of arms 96 which are angled and extending away from spanning member 94 and towards the second slot 80 of the front edge member 52. Ends 97 of arms 96 are shaped to fit in second slot 80 and are secured therein with screw fasteners. Because the bracing members 92 are positioned between the illumination means 18 and the flexible face material 22, the closer they are positioned to the illumination means, the less shadow will appear on the front face 20 of the sign. Members 92 are thus C-shaped with the spanning member 94 being adjacent illumination means 18. The bracing members 92 give lateral support to the front sign casing 12 allowing it to be pivoted about the rear sign casing 14.

Figure 4:
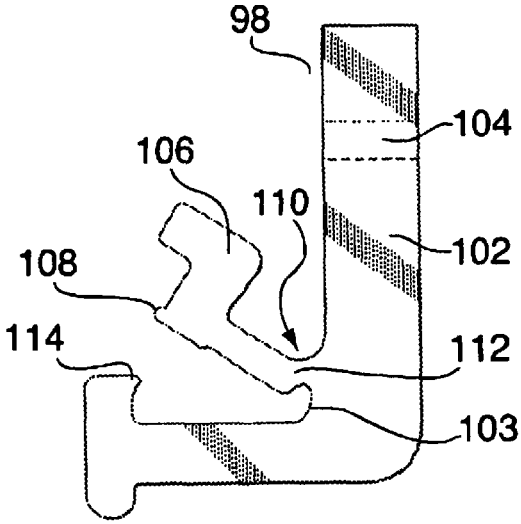
FIG. 4 illustrates in a side elevation view, a tension clip used in the framing system.

Referring to FIG. 4, a pluralty of tension clips 98 are removably secured within the main recess 62 and are for holding onto an edge 100 of the flexible face material 22. Clips 98 comprise an L-shaped member 102 having a screw hole 104 through it. From the inside corner 103 of the L-shaped member 102 extends a clamping leg 106 having a heel 108 thereon. When the edge of the flexible material is inserted between the member 102 and the clamping leg 106, the leg is pivoted about a hinge 110 which is merely a narrowed neck 112. The heel 108 is snap-fit into a lip 114 and thereby clamps onto the flexible material.

Each tension clip 98 is attached to the front edge member 52 with a screw fastener 116 which goes through screw hole 104, between parallel webs 78. The distance between the webs 78 is slighty less than the diameter of the screw fastener 116 and the pitch of ridges 79 allows the threads in the screw to grip into the ridges, thereby solidly securing itself between the webs. The screws are preferably made of steel and do eventually shear portions of the aluminum ridges of the webs to solidly attach to the extrusion. However, they may be repositioned along the extrusion as necessary. Tension clip 98 fits into main recess 62, and the clamping leg and lip assembly fits into secondary recess 118, when the fastener 116 is tightened. Because the tension clips merely grasp the flexible face, it does not damage the material and therefore extends its useful life.

The front sign casing also comprises a cap 120 which fits to cover the main recess 62 of the front edge member. The cap 120 extends between the first slot arm 68, and lip 86 of angulated arm 82. A first weather gasket 122 is positioned between indentation 72 on first slot arm 68 and cap 120 and acts to prevent water infiltration form the top of the casing into the front edge member. Flexible face material 22 passes between cap 120 and lip 86 of angulated arm 82, and then into tension clip 98. The face material is held in tension between the tension clip and the angulated arm 82. Because off the angle in the arm, when the screw fastener 116 is turned, the clip is driven partially towards the angulated arm which increases the tension in the flexible face.

A second weather gasket 124 is positioned between the front flange 42 of the extrusion 34 of the rear sign casing and the primary member 66 of the front edge member. The second gasket is for preventing water infiltration from between the front and back sign casings and into the interior portion of the sign.

Front sign casing 12 is pivotally connected to rear sign casing 14 via a hinge 126 mounted to the extrusion 34 of the top member 24, the hinge allowing front sign casing to pivot about the hinge and expose the interior portion of the rear sign casing.

The flexible face material 22 covers the front face 20 of the front sign casing 12 and extends between tension clips 98 in the front edge member of the top member 54 and those in the bottom member 56, and between tension clips 98 in the front edge member of the first end member 58 to those in the second end member 60. Screw fasteners 128 are for securing the bottom 56 front edge member 52 to the bottom panel 26 of the extrusion 34.

To install the system, the rear casing 14 is fitted with illumination means 18. Flexible face material 22 is fitted around its edge 100 with a plurality of tension clips 98 which are inserted within main recess 62 of the front edge member 52. The clips are secured to the front member with the screw fasteners 116. Once the flexible face material 22 is completely inserted within the casing, caps 120 are mounted over the main recess in members 54, 56, 58 and 58.

Once the sign casing is installed in its desired site, its interior can be accessed by releasing screw fasteners 128 from the bottom member, and the front sign casing 12 can be pivoted about the hinge 126 to allow the illumination means 18 to be inspected, repaired or changed. If the flexible face material loses some of its tautness after a period of time, the tension in the face can be increased simply by tightening the screw fasteners 116, whereby the tension clips would be inserted deeper into main recess 62, and slightly towards angulated arm 82, and pull the face material tighter.

In addition, the shape of angulated arm 82 allows the light rays from the illumination means to reach the entire outside surface of the front face 20. The sign casings can be connected to one another in order to make them longer by insert the connection tongue 76 into first slot 74. The connection feature also allows for easier transportation of the longer sign casings. Because of the two part casing, the rear casing which contains the illumination means and which must be maintained in one piece, can be transported separately from the front casing 12. The front casing sections can be folded onto one another, even with the face material installed, with the flexible face material acting as a hinge between the lengths of front casing 12. With one piece sign casing, the flexible face must be installed on site since transportation of long specimens with the flexible material installed is liable to cause damage to the front face and therefore render the sign useless. This site installation is very difficult and even dangerous. With the two part casing, the flexible material can be installed at the plant and then transported to the site with the flexible face safety protected between the respective lengths of the front casing. On site, all that has to be done is insert the connection tongues inside the first slots and install the front casing onto the rear casing and install the sign onto the site.

The above-described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

What is claimed:

1. A flexible face sign framing system comprising:

a rear sign casing having an inside portion, said casing including a back panel, a top and a bottom panel, first and second end panels, said inside portion for containing an illumination means;

a front sign casing pivotally secured to the rear sign casing, said front casing having:

a top front edge member, a bottom front edge member, and first and second end front edge members;

a front face covered by a flexible face material;

a tension clip removably secured to at least the top and bottom front edge members, said clip having clamping means for holding an edge of the flexible face material; and a hinge between the top front edge member and the top panel, said hinge for pivotal movement of the front sign casing;

wherein the top front edge member, a bottom front edge member, and first and second end front edge members form a tension device for holding an edge of the flexible face material, said device comprising top and bottom front edge extrusions, each having a first slot extending longitudinally and for receiving a connection tongue; a pair of ridged webs extending longitudinally adjacent the first slot; members forming a second slot extending longitudinally, located under the pair of webs; an arm extending from the members forming the second slot, said arm having a lip at its free end for supporting the flexible material; a plurality of second bracing members secured to the second slot on the top and bottom front edge extrusions; a plurality of said tension clips being removably secured within a recess in the top and bottom front edge extrusions, said clips having a said clamping means for holding onto an edge of the flexible face material, said clips being secured to the extrusions using a screw fastener engaging the pair of ridged webs, said fasteners and clips for applying tension to the flexible face material; said hinge secured to the top panel of the rear sign casing and to the top front edge extrusion, said hinge for pivotal movement of the front sign casing about the rear sign casing; and a plurality of screw fasteners for securing the bottom front edge extrusion of the front sign casing to the bottom panel of the rear sign casing.

2. A sign framing system as in claim 1 wherein said top, bottom and end panels of said rear sign casing are extrusions having front and rear flanges, said back panel being secured to the rear flanges of the extrusion of the top, bottom, and end panels; said rear sign casing also comprising a plurality of first bracing members being secured to each of the top, bottom, and back panels.

3. A sign framing system as in claim 1 further comprising a cap having a lip for covering the lip of the arm, said cap for covering the recess in the top and bottom front edge extrusions.

4. A sign framing system as in claim 1 wherein the front edge extrusions are made of aluminum.

5. A sign framing system as in claim 1 wherein the screw fasteners are made of steel.

6. A flexible face sign framing system comprising:

(A) a rear sign casing having an interior portion for enclosing illumination means, said rear casing having top, bottom, first end, second end and back panels and a plurality of bracing members secured to each of the top, bottom and back panels;

(B) a front sign casing for supporting a flexible face material over a front face of a sign, said front casing pivotally mounted on the rear sign casing and including:

(i) a front edge extrusion forming top, bottom, and first and second end members, said front edge extrusion having a main recess and including:

a pair of slot members extending longitudinally within the recess and forming a first slot, said slot for receiving a connection filler;

a pair of ridged webs extending longitudinally;

a second slot extending longitudinally, located under the pair of ridged webs;

an arm extending from members forming the second slot said arm having a lip at its free end for supporting the flexible material;

(ii) a plurality of support members secured within the second slot on the top and bottom members;

(iii) a plurality of tension clips removably secured within the recess, said clips having clamping means for holding onto an edge of the flexible material, said clips being secured to the extrusion using a screw fastener engaging the pair of ridged webs, said fastener and clips for applying tension to the flexible face material;

(iv) a cap for covering the recess in the front edge extrusion said cap having a lip for covering the lip of the arm;

(C) a hinge secured to the top panel of the rear casing and the front edge extrusion of the top member, said hinge for pivotal movement of the front sign casing about the rear sign casing;

(D) said flexible face material for covering the front face of the front sign casing;

(E) a plurality of screw fasteners for securing the front edge extrusion of the bottom member to the bottom panel of the rear sign casing.

7. A sign framing system as in claim 6 wherein rear sign casing comprises a rear sign casing extrusion having front and rear flanges, said rear sign casing extrusion forming a top panel, a bottom panel and first and second end panels; a back panel secured to the rear flange of the extrusion of the top, the bottom and the first and second end panels; and the plurality of U-shaped bracing members secured to each of the top and bottom panels and the back panel.

8. A sign framing system as in claim 6 further comprising a first weather gasket positioned between the cap and the front edge extrusion, and a second weather gasket positioned between the front flange of the panel extrusion of the rear sign casing and the front edge extrusion.

9. A sign framing system as in claim 6 wherein the arm is angulated.

10. A sign framing system as in claim 6 wherein the front edge extrusions are made of aluminum.

11. A sign framing system as in claim 6 wherein the screw fasteners are made of steel.

12. A flexible face sign framing system comprising:

(A) a rear sign casing having an interior portion for containing illumination means, said rear casing including:

(i) an extrusion panel having front and rear flanges, said extrusion forming a top panel, a bottom panel and first and second end panels;

(ii) a back panel secured to the rear flanges of the extrusion panel;

(iii) a plurality of U-shaped bracing members secured to each of the top and bottom panels and the back panel;

(B) a front sign casing for supporting a flexible face material over a front face of a sign said front casing pivotally mounted on the rear sign casing and including:

(i) a front edge extrusion forming top, bottom, and first and second end members, said front edge extrusion having a main recess and including:

a rearwardly extending member for connection to the extrusion panel;

a primary member extending perpendicularly from the rearwardly extending member and towards an interior portion of the sign;

first and second slot arms extending from the primary member and substantially parallel to the rearwardly extending member, said first slot arm having an indentation thereon, said first and second slot arms forming a first slot extending longitudinally along the extrusion and for receiving a connection filler;

a pair of parallel ridged webs extending longitudinally and angled towards the recess and away from the primary member;

a second slot extending longitudinally, located under the parallel webs;

an angulated arm extending from the primary member forming the second slot substantially parallel to the webs, said angulated arm having an elbow at its midpoint and having a bottom lip at its free end;

(ii) a plurality of C-shaped bracing members secured within the second slot of the front edge extrusion on the top and bottom members;

(iii) a plurality of tension clips removably secured within the recess in the front edge extrusion, said clips having a clamping leg for holding onto an edge of the flexible material;

(iv) a plurality of screw fasteners for securing the clips into the recess, said fasteners passing through the tension clips and engaging the ridged webs of the front edge extrusion, said fasteners and clips for applying tension to the flexible face material;

(v) a cap having a first end for connecting to the first slot arm of the front edge extrusion and a second end having a lip for covering the lip of the angulated arm, said cap for covering the recess in the front edge member;

(vi) a first weather gasket positioned within the indentation of the first slot arm, between the cap and the first slot arm;

(vii) a second weather gasket positioned between the front flange of the extrusion panel of the rear sign casing and the primary member of the front edge extrusion;

(C) a hinge secured to the top extrusion panel and the rearwardly extending member of the top front edge extrusion, said hinge for pivotal movement of the front sign casing about the rear sign casing;

(D) said flexible face material for covering the front face of the sign casing;

(E) a plurality of screw fasteners for securing the bottom extrusion panel and the rearwardly extending member of the bottom front edge extrusion of the front sign casing.

13. A sign framing system as in claim 12 are the front edge extrusions are made of aluminum.

14. A sign framing system as in claim 12 wherein the screw fasteners are made of steel.

15. A flexible face sign framing device comprising:

a front edge extrusion forming top, bottom, and first and second end members, said front edge extrusion having a main recess and including:

a rearwardly extending member for connection to the front edge extrusion;

a primary member extending perpendicularly from the rearwardly extending member and towards an interior portion of the sign;

first and second slot arms extending from the primary member and substantially parallel to the rearwardly extending member, said first slot arm having an indentation thereon, said first and second slot arms forming a first slot extending longitudinally along the extrusion and for receiving a connection filler;

a pair of parallel ridged webs extending longitudinally and angled towards the recess and away from the primary member;

a second slot extending longitudinally, located under the parallel webs;

an arm extending from the members forming the second slot substantially parallel to the parallel webs, said arm having an elbow at its midpoint and having a bottom lip at its free end;

a plurality of tension clips removably secured within the recess in the front edge extrusion, said clips having clamping means for holding onto an edge of the flexible material;

a plurality of screw fasteners for securing the clips into the recess, said fasteners passing through the tension clips and engaging the ridged webs of the front edge extrusion, said fasteners and clips for applying tension to the flexible face material.

16. A sign framing system as in claim 15 further comprising a cap having a first end for connecting to the first slot arm of the front edge extrusion and a second end having a lip for covering the lip of the arm, said cap for covering the recess in the front edge member; a first weather gasket positioned within the indentation of the first slot arm, between the cap and the first slot arm; a second weather gasket positioned between the front flange of the extrusion panel of the rear sign casing and the primary member of the front edge extrusion; and, a flexible face material for covering the front face of the sign casing.

17. A sign framing system as in claim 15 wherein the arm is angulated.

* * * * *